United States Patent [19]

Zinbarg

[11] Patent Number: 4,501,358

[45] Date of Patent: Feb. 26, 1985

[54] DESK SET WITH INTEGRALLY FORMED SWIVEL CLAMPING MEANS

[76] Inventor: Benson Zinbarg, 111 Chestnut Hill La., Stamford, Conn. 06903

[21] Appl. No.: 546,482

[22] Filed: Oct. 28, 1983

[51] Int. Cl.[3] ..... B43M 17/00; A47F 7/00

[52] U.S. Cl. ..... 206/371; 206/214; 211/69.5; 211/69.6

[58] Field of Search ..... 206/371, 214; 220/26; 211/69.5, 69.6

[56] References Cited

U.S. PATENT DOCUMENTS

| | | | |
|---|---|---|---|
| 470,668 | 3/1892 | Fisher | 211/69.5 |
| 1,814,085 | 7/1931 | Guyot | 211/69.6 |
| 1,868,505 | 7/1932 | Nakahara | 211/69.6 |
| 1,956,084 | 4/1934 | Tefft | 211/69.6 |
| 2,666,290 | 1/1954 | Kaufman | 211/69.6 |
| 3,409,122 | 11/1968 | Hayes et al. | 206/214 |
| 3,810,550 | 5/1974 | Longarzo | 211/69.6 |
| 4,176,743 | 12/1979 | Fitzpatrick | 206/214 |

FOREIGN PATENT DOCUMENTS

| | | | |
|---|---|---|---|
| 68427 | 1/1941 | Czechoslovakia | 211/69.6 |
| 934507 | 8/1963 | United Kingdom | 211/69.6 |

*Primary Examiner*—William T. Dixson, Jr.
*Assistant Examiner*—Brenda J. Ehrhardt
*Attorney, Agent, or Firm*—Frishauf, Holtz, Goodman and Woodward

[57] ABSTRACT

A desk set with integrally formed swivel clamping means which can be injection-molded without use of a cam-action mold. The swivel clamping means comprises four semicylindrical clamping members (28) inclined toward each other to form a socket for a ball (26) attached to an accessory support stem (24) for holding a pen (30), a clock (32), or the like. To increase friction between the ball (26) and the socket, the socket clamping members (28) each include an inwardly pointing lip (46) and the surface of the ball (26) is covered with alternating slots (38,42) and ridges (40,44).

6 Claims, 7 Drawing Figures

DESK SET WITH INTEGRALLY FORMED SWIVEL CLAMPING MEANS

The present invention relates generally to desk top accessory holders and more particularly to a desk set with an integral swivel mounting which can be injection molded without using a cam-action mold.

BACKGROUND

Desk top accessory holders have traditionally included a supply of paper, a receptacle for paper fastening means such as paper clips or rubber bands, and at least one writing instrument, such as a sleeve for supporting a pen in an upwardly or diagonally projecting position. Frequently, the sleeve includes a hinged or swivel mounting with respect to the base.

The base plate and compartment walls of desk sets are often produced by injection molding. However, because it has been considered difficult to injection mold, without use of a special cam-action mold, anything unless the sidewalls of all of its integral portions were vertical, the molds have generally just produced a hole, to which a separate metal or other ball and socket joint could be attached by a bolt and nut arrangement. The necessity for separate manufacture of the ball and socket and of labor-intensive assembly work substantially increased the cost of the final product. Likewise, use of a cam-action mold increases the number of manufacturing motions, decreases production rates, and increases costs. Cam-action molds are also expensive to make.

SUMMARY OF THE INVENTION

It is an object of the present invention to provide a desk set with an integrally formed swivel socket which can be molded in a single operation.

Briefly, a horizontal base member is formed with an integral accessory holder which comprises a plurality of semicylindrical clamping members which cooperate to form a socket between them. The clamping members incline slightly toward each other at ends remote from the base member. They thus are wrapped slightly around part of the mold during the molding process. However, there are slots separating the clamping members, so that they will temporarily deform outwardly from each other enough to permit extraction of the part of the mold between them. They then rebound to their initial configuration. When a ball member is subsequently forced into the socket between the clamping members, they act to resiliently clamp the ball in place while permitting swivel and rotating movements of the ball in the recess.

To further secure the ball in the socket thus formed, the clamping members are each preferably provided with a lip on their ends remote from the base member. The lips project toward the center of the socket and help to hold the ball in place.

The ball itself is preferably integrally formed with a sleeve which holds, for example, a pen or a clock, and has two hemispheres which may be conveniently be divided on an equatorial mold line which is perpendicular to the axis of the sleeve. Each hemisphere includes a plurality of vertical slots alternating with ridges, but the slots on the upper hemisphere are preferably staggered with respect to those on the lower hemisphere and the ridges are preferably slightly wider than the slots, so that each ridge on one hemisphere is contiguous at the equatorial mold line with two ridges on the other hemisphere. These ridges and the equatorial mold line serve to increase friction between the clamping members of the socket and the ball.

These features assure that the desk unit and socket of the present invention can be molded in a single step, as can the ball and sleeve unit, so that the only final assembly steps necessary are snapping the ball into the socket and sliding the pen or clock into the sleeve.

DETAILED DESCRIPTION

Figure 1:
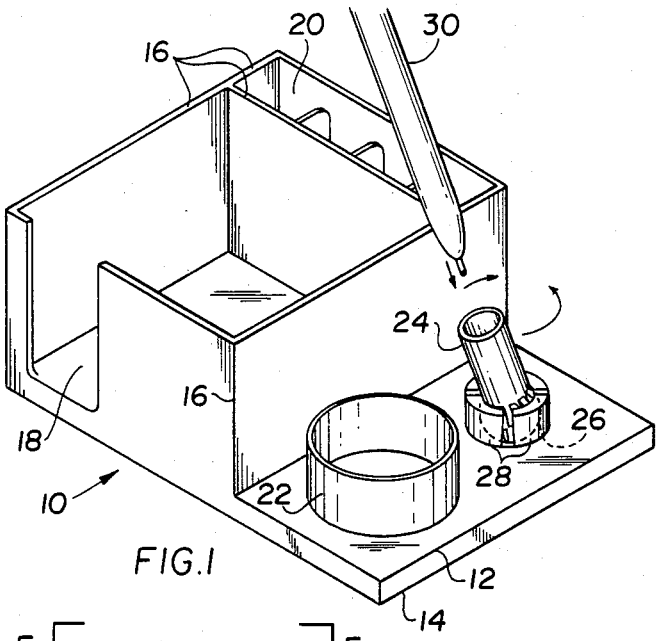
FIG. 1 is a perspective view of the desk set, with the swivel ball and socket configured to receive a pen.

As shown in FIG. 1, the first embodiment 10 of the desk set includes a base member 12 with a depending peripheral skirt 14. A number of vertical walls 16 create open-topped compartments 18 for a stack of note paper or the like, and 20 for pencils or the like. A cylindrical wall 22 forms a receptacle for paper clips or rubber bands. A pen-holding sleeve 24 is integrally formed with a generally ball-shaped member 26 (hereinafter "ball") shown in phantom, which is held in place by socket clamping members 28, of which four are illustrated. A pen 30 may be inserted in the sleeve 24 when not in use.

Figure 2:
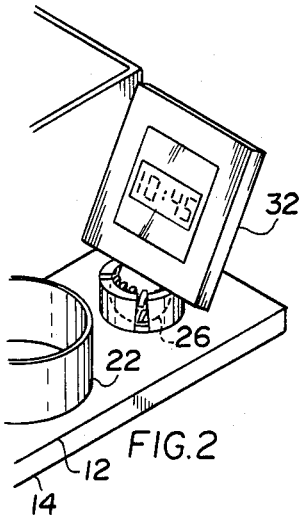
FIG. 2 is a fragmentary perspective view of a second embodiment, in which the ball and socket mounting supports a clock.

As shown in FIG. 2, a digital clock 32 or other desk accessory may be substituted for the pen-holding sleeve 24 and pen 30. In this case, the housing of the clock 32 is preferably integrally formed with the ball 26. Alternatively, the clock 32 may have a projection fitting into the sleeve 24 of FIG. 1 in substantially the same manner as the pen 30.

Figure 3:
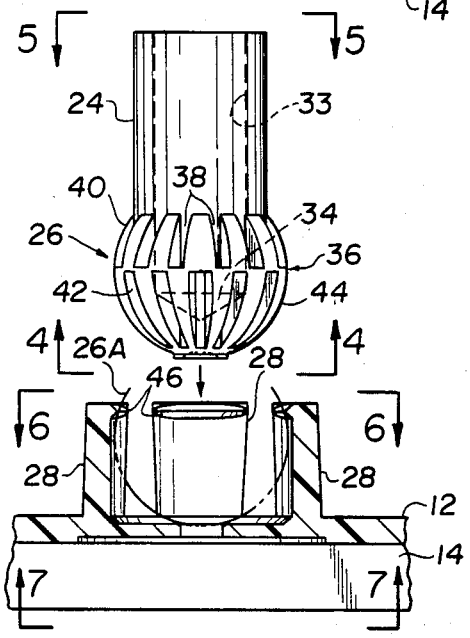
FIG. 3 is an enlarged cross-section of the socket, taken along line 3—3 of FIG. 1, with the ball and sleeve disengaged therefrom.

FIG. 3 is an enlarged and exploded view of ball 26 and socket clamping members 28, with the socket shown in cross-section. The hollow interior of sleeve 24 includes a cylindrical section 33 for receiving the pen and a conical section 34 (both shown in phantom) for receiving the point of the pen. The ball 26, when inserted into the socket, occupies the position shown in phantom as 26A. The ball need not necessarily be round, and could be oval or even cylindrical for certain applications, but a round configuration is preferred because it facilitates rotation, as well as swiveling in a particular direction. The ball 26 has an equatorial line 36 which may be conveniently be the parting line of the mold which makes the ball. The upper hemisphere of the ball includes vertical slots 38 separated by ridges 40. Similarly, the lower hemisphere has vertical slots 42 separated by radial ridges 44. The projection mold line 36 and the ridges 40, 44 serve to increase friction between the ball and the socket, helping to retain the ball in the socket and to prevent wobbling.

Also illustrated is the side of peripheral skirt 14 which depends from base member 12 (shown in section). The socket clamping members 28 have inwardly projecting lips 46 on their outer ends, remote from the base member 12. These lips act as detents to retain the ball 26 in the engaged position shown at 26A. The clamping members 28 are preferably integral with base member 12 and inclined at their outer ends toward a central axis perpendicular to said base member 12.

Figure 4:
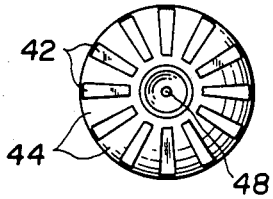
FIG. 4 is a bottom view of the ball taken along line 4—4 of FIG. 3.

FIG. 4 illustrates the preferred embodiment of the slots and ridges of the lower hemisphere of ball 26. Twelve slots 42 are illustrated, spaced about 30 degrees apart, but a greater or lesser number could also be used. The slots preferably extend somewhat more than halfway to the central axis 48 of the ball. The intervening ridges 44 are preferably slightly wider than the slots 42.

Figure 5:
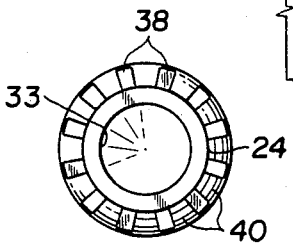
FIG. 5 is a top view of the sleeve and ball taken along line 5—5 of FIG. 3.

FIG. 5 illustrates the end of sleeve 24 with its hollow interior 33, as well as the slots 38 and ridges 40 on the upper hemisphere of the ball.

Figure 6:
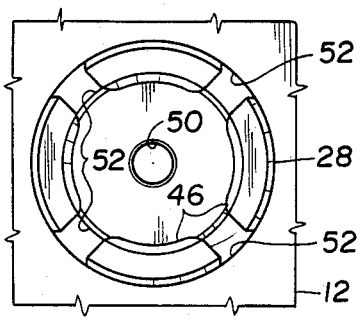
FIG. 6 is a top view of the socket taken along line 6—6 of FIG. 3.

FIG. 6 is an enlarged top view of the socket clamping members 28 with their lips 46. A central hole 50, and four holes 52 between the semicylindrical members 28 are formed through the base member 12.

Figure 7:
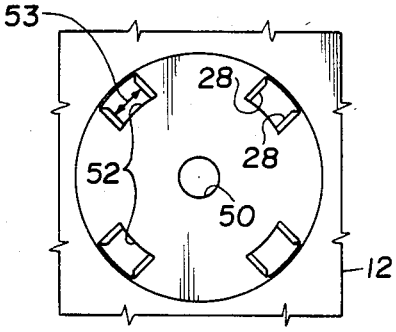
FIG. 7 is a bottom view of the socket, taken along line 7—7 of FIG. 3.

As shown in FIG. 7 from below, the spaces 53 between the clamping members 28 are narrower at the outer ends of members 28 than they are at the holes 52 adjacent the base member 12, so that the sidewalls of the clamping members 28 are visible through the holes 52. Thus, after molding, the clamping members 28 are temporarily forced apart circumferentially, as well as radially, when the upper half of the mold is extracted. See also FIGS. 1 and 2.

Thus, it is possible to injection-mold a desk set with a ball and socket mounting which swivels through an angle of over 75 degrees, all without resort to cam-action molds and screw-on attachments. Various changes and modifications may be made within the scope of the inventive concept.

I claim:

1. A desk set for holding desk accessories comprising:

a base member (12);

socket forming means (28) integrally molded with said base member (12) for forming a socket with resilient clamping action, said socket forming means comprising a plurality of spaced apart part-cylindrical clamping members (28) integrally projecting out of said base member (12) and inclined at their outer ends toward a central axis perpendicular to said base member;

a generally ball-shaped member (26) adapted for insertion into said socket for swivel engagement with said socket and for removal therefrom, the surface of said ball-shaped member (26) being formed with alternating substantially radially directed slots (38,42) and ridges (40,44), and a substantially equatorial mold line (36) which divides the ball surface into upper and lower portions, the slots (38) on one of said upper and lower portions being staggered with respect to the slots (42) on the other of said upper and lower portions, so that each ridge on said one portion is at least partially continuous with at least one ridge on said other hemisphere, said equatorial mold line being arranged to at least partially engage with said clamping members of said socket to increase the frictional engagement therebetween; and an accessory means coupled to said ball-shaped member so as to be swivel supported on said base member.

2. The desk set of claim 1, wherein said clamping members (28) include integrally formed inwardly projecting lips (46).

3. The desk set of claim 2, wherein said projecting lips are formed at the end portions of said clamping members (28) remote from said base member (12).

4. The desk of claim 1, wherein said portions of said ball-shaped member comprise upper and lower hemispheres.

5. The desk set of claim 1, wherein said accessory means comprises a sleeve for movably receiving a pen therein.

6. The desk set of claim 1, wherein said accessory means comprises a clock coupled to said ball-shaped member.

* * * * *